United States Patent [19]

Schregenberger

[11] 4,326,342

[45] Apr. 27, 1982

[54] MULTI-ZONE OVEN WITH COOL AIR MODULATION

[75] Inventor: Alex J. Schregenberger, Neshanic, N.J.

[73] Assignee: Midland-Ross Corporation, Cleveland, Ohio

[21] Appl. No.: 176,251

[22] Filed: Aug. 7, 1980

[51] Int. Cl.[3] ..... F26B 13/02; F26B 21/12

[52] U.S. Cl. ..... 34/47; 34/48; 34/54; 34/212; 34/216; 432/59; 432/72; 118/58

[58] Field of Search ..... 34/79, 210, 215, 216, 34/217, 47, 48, 54, 212; 432/59, 72; 118/58, 61, 68, 69

[56] References Cited

U.S. PATENT DOCUMENTS

| | | | |
|---|---|---|---|
| 3,917,444 | 11/1975 | Carthew | 432/72 |
| 4,087,923 | 5/1978 | Wilt, Jr. et al. | 34/79 |
| 4,206,553 | 6/1980 | Ellison et al. | 34/79 |

*Primary Examiner*—Larry I. Schwartz

*Attorney, Agent, or Firm*—Harlan E. Hummer

[57] ABSTRACT

An oven is disclosed as having a plurality of chambers which are sealed from the ambient atmosphere, and to which gas, heated to a high temperature outside the chambers, is circulated to each of the chambers for admixture with gas which is cool compared to the high temperature gas, to produce in the chambers a mixture of hot and cool gas at a predetermined temperature. The hot gas is circulated to the chambers at a certain desired pressure, wherein the cool gas is circulated to the chambers at a certain rate of flow. Gas is exhausted from the oven also at a fixed rate of flow. The gas pressure in the first oven to be encountered by an element passing through the oven, is monitored and triggers a change in the flow of cool gas when the pressure varies from a desired norm. This change in flow of cool gas influences the temperature which is also monitored. A change in the temperature produces a corresponding change in the mixture of hot and cool gas to return the oven temperature to the desired level.

17 Claims, 7 Drawing Figures

MULTI-ZONE OVEN WITH COOL AIR MODULATION

BACKGROUND OF THE INVENTION

The invention is applicable to any oven and, in particular, to a strip floater oven which is used in conjunction with a device for applying some type of coating, e.g. paint, to a continuous element such as a sheet of metal. Such an oven is described in my copending application Ser. No. 046,796 filed June 8, 1979 now U.S. Pat. No. 4,299,036 and generally comprises a number of horizontally aligned chambers which are disposed side by side and sealed from each other and the ambient atmosphere. A sheet of metal is guided horizontally through the coating device and then successively through the individual heat treatment chambers or zones wherein it is contacted with heated gas to dry and cure the coating of paint by removal of the paint carrying solvent as a highly volatile vapor in the heated gas exhausted from the various chambers.

Heated gas is impinged upon the traveling sheet of metal in each of the heat treatment chambers from a number of nozzles which are positioned vertically above and below the sheet of metal and which are normally at least coextensive with the width of the sheet of metal. Good workable nozzles for use in so-called HV (high velocity) zones where gases are impinged upon the traveling element or web at relatively high velocities are of the floatation type, as disclosed in U.S. Pat. Nos. 3,837,551 and 3,982,327. A nozzle of the direct impingement type, as disclosed in U.S. Pat. No. 2,574,083, is used in so-called PH (preheat) zones wherein the element is preheated, prior to passage through the HV zones.

In prior art ovens, heated gas is brought to and exhausted from, the individual chambers of the oven in much the manner taught, for example, by U.S. Pat. No. 3,923,449. Generally, each treatment chamber is provided with a costly burner system which is used to individually condition the temperature of the heated gas circulated to that particular chamber. Spent gas, including solvent vapor, is separately removed from each of the chambers and exhausted in a common flue. The volume of gas exhausted from the oven is predetermined to maintain the concentration of solvent vapor at or below 25% of its lower explosive limit (LEL). Higher solvent vapor concentration (up to 50% of the LEL) may be used if the solvent vapor concentration of the exhaust gas is carefully monitored. This is done by continuously removing a portion of the exhaust gas from the common flue and measuring it for its solvent content. It can be appreciated that the solvent content of gas in the main exhaust stream is not a true reflection of the actual concentration of solvent vapor in any of the individual chambers or zones. For example, the concentration of solvent vapor may be dangerously high in one chamber, but offset by a low concentration of solvent vapor in another chamber.

The oven of the invention of my aforementioned copending application utilizes a single source of heat, such as a conventional fume incinerator, as a means of heating gas which is successively cascaded through the various chambers from the last to the first chamber to be encountered by the traveling element, such that a measure of the solvent vapor concentration of the exhaust gas exiting the first to be encountered chamber, is a true representation of the maximum concentration of accumulated solvent vapor within the oven.

The oven of this invention employs a central heat source, but it is utilized differently from that described in my copending application. Further, this invention is directed to what is believed to be an even simpler system for controlling the temperature of the heated gas in the various chambers or zones of a multi-zone oven.

Briefly stated, the invention is in an oven which comprises at least one chamber which is substantially sealed from the ambient atmosphere and which is designed to have a web or element, to be heated, passed substantially horizontally therethrough. Means are provided for circulating gas, heated at a single outside heat source to a certain temperature, to the chamber at a predetermined constant pressure for subsequent impingement against the element at a relatively high velocity as the element travels through the chamber. Means are supplied for mixing cooler gas with the heated gas, prior to circulation of the mixture to the chamber to produce, in the chamber, a predetermined desired gas temperature which is monitored by a temperature sensing device that acts to regulate the amount of hot and cool gas in the mixture. Means are provided for exhausting gas from the chamber at a predetermined flow rate. Means are used for monitoring the gas pressure within the chamber and for changing the amount of cooler gas in the mixture, when the gas pressure within the chamber varies from a desired norm, after the oven is, in balance, and operating at a desired temperature. The change of cooler gas in the mixture naturally influences the gas temperature being monitored in the chamber by the temperature sensing means to correspondingly regulate the mixture of hot and cool gas to return the chamber back to the desired temperature. The balance of the oven is controlled and maintained primarily by modulating the flow of cool gas while keeping the pressure of the high temperature gas constant.

Other aspects of the invention are the use of a fume incinerator as a source of heating the gas to high temperatures, and the circulation of the exhaust gas to the fume incinerator for reheating and recirculation to the chamber. Also, gas is constantly removed from the chamber for combination with the mixture of hot and cool gas, prior to circulation of the mixture to the chamber.

The basic oven of this invention is highly simplified and does not require the use of a number of costly gas burners as do prior art ovens, or the use of heat exchangers as does the oven of my copending application, since the gas, heated in the single fume incinerator, is circulated directly to the various chambers or zones. The invention is readily adapted to existing ovens because of its simplicity of design and control mechanisms.

DESCRIPTION OF THE DRAWING

The following description of the invention will be better understood by having reference to the accompanying drawing, wherein.

THE INVENTION

Figure 1:
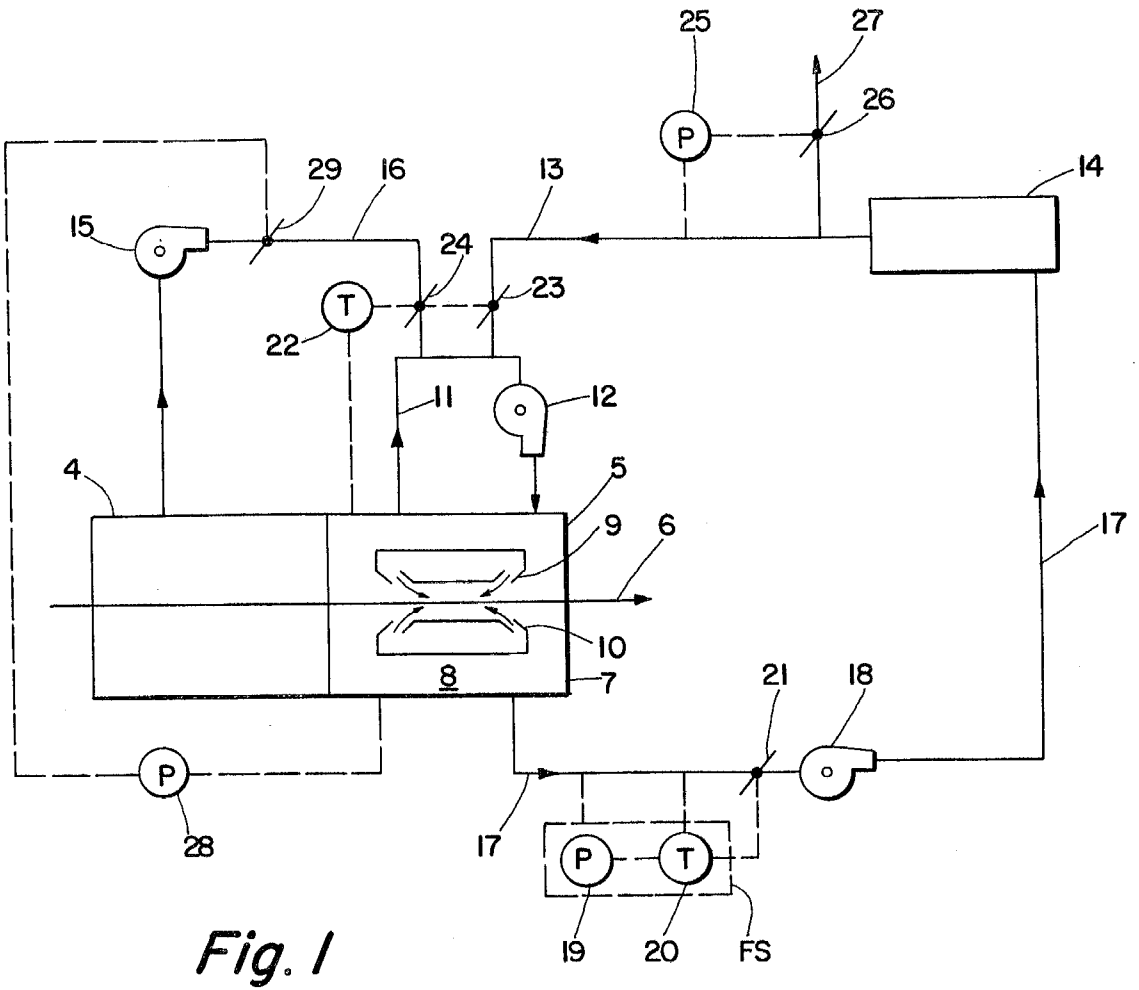
FIG. 1 is a schematic of a basic oven employing a single heat treatment chamber or zone.

With general reference to the drawing for like parts, and more particular reference to FIG. 1, there is shown a conventional coating apparatus 4 with a connecting oven 5 through which a continuous web or element 6, such as a newly painted strip of metal, is passed for treatment, e.g. drying and curing of the paint by removal of the paint carrying solvent as a vapor. The basic unit or oven 5 is a high velocity (HV) oven having a single heat treating zone 7 which comprises a chamber 8 that is sealed from the ambient atmosphere and the adjacent coater 4. The chamber 8 is provided with horizontally aligned openings through which the element 6 is drawn through the heat treatment zone 7 or chamber 8 in a generally horizontal pathway by any conventional means. Any suitable seals are provided at these openings to seal the chamber 8 from the ambient atmosphere and adjacent coater 4. Two confronting rows of transversely oriented nozzles, e.g. nozzles 9,10, are positioned in the chamber 8 for impinging high velocity streams of temperature conditioned gas, e.g. air, against opposing faces of the continuous element 6 to support and guide the element 6 as it travels along a horizontal pathway between the rows of nozzles 9,10, unsupported by any conventional guide rollers which are normally used to support such a traveling element. The nozzles 9,10 may be of the floatation type, as previously mentioned in connection with U.S. Pat. Nos. 3,837,551 and 3,982,327.

The basic oven 5 is provided with a gas recirculating line 11 which contains a high pressure fan or blower 12 that is used to continuously circulate heated gas, removed from the chamber 8, back to the nozzles 9,10. The recirculating line 11 is in communication with an inlet conduit 13 that leads from a conventional fume incinerator 14 which is used to heat gas to high temperatures of, for example, 1000° F. to 1500° F. for admixture with the heated gas removed from the chamber 8 and cool gas from any suitable source, e.g. the coating apparatus 4 from which cool gas at temperatures of, for example, 70° F. to 90° F. is circulated by means of a high velocity blower or fan 15 through piping 16 that is also connected to the recirculation line 11. The hot and cool gases are blended to produce a treatment gas, at a desired temperature for circulation to the nozzles 9,10, of the heat treating zone 7. An exhaust line 17 leads from the chamber 8 to the fume incinerator 14 and contains a conventional blower or fan 18 which is used to circulate exhaust gas, e.g. air containing solvent vapor, at a predetermined desired rate of flow from the chamber 8 to the fume incinerator 14 for temperature conditioning and subsequent recirculation to the nozzles 9,10, via the recirculating line 11 where the hot gas becomes part of the mixture of treatment gas.

A conventional gas flow sensor FS, including a pressure differential sensing device 19 and a temperature sensing device 20, is used to monitor the flow of exhaust gas in the exhaust line 7. The gas flow sensor FS controls the operation of a damper 21 that is used to regulate the flow of exhaust gas to the fume incinerator 14 from the chamber 8. A temperature sensing device 22, provided to sense the temperature of the gas within the chamber 8, controls the operation of a pair of dampers 23,24 in the hot gas conduit 13 and cool gas piping 16 to regulate the mixture of hot and cool gas and consequent temperature of the treatment gas circulated to the nozzles 9,10. A pressure sensing device 25, used to monitor the pressure of hot gas flowing from the fume incinerator 14, controls the operation of a damper 26 which is utilized to regulate the pressure of hot gas by diverting, some of the hot gas through a discharge line 27 into the ambient atmosphere. The gases downstream of a properly working incinerator are clean enough to release to the atmosphere. The aforementioned pressure and temperature sensing devices are used to balance operation of the oven by maintaining a constant and desired flow rate of hot and cool gas to and from the oven 5 to correspondingly maintain the temperature of the treatment gas within the oven at a desired level.

A sensor 28 is provided to sense the gas pressure within the chamber 8. Should the gas pressure vary the desired norm within the chamber 8, then the sensor 28 will actuate operation of a damper 29 which controls the flow of cool gas from the coater 4 through the piping 16 to the recirculating line 11 where the cool gas is mixed with the hot, high temperature gas from the fume incinerator and the heated gas being continuously removed from the heat treatment chamber 8. The change in the flow of cool gas causes a change in the mixture of hot and cool gas which influences and causes a temperature change of the gaseous atmosphere within the chamber 8. This, in turn, causes a reaction of the temperature sensing device 22 to vary, if necessary, the flow of hot, high temperature gas from the incinerator 14 and consequent amount of hot gas in the mixture. Several fluctuations of the temperature may occur until the oven is returned to a balanced condition. Thus, it can be appreciated that once the oven is properly balanced, it is only necessary to modulate the flow of cool gas to the chamber to return the oven back to a balanced position should the oven, for any reason, become unbalanced. Such a system is much simplified from that mentioned in my copending application, wherein the temperature of the hot gas is manipulated and varied in response to changes of temperature within the chambers of the various heat treatment zones.

Figure 2:
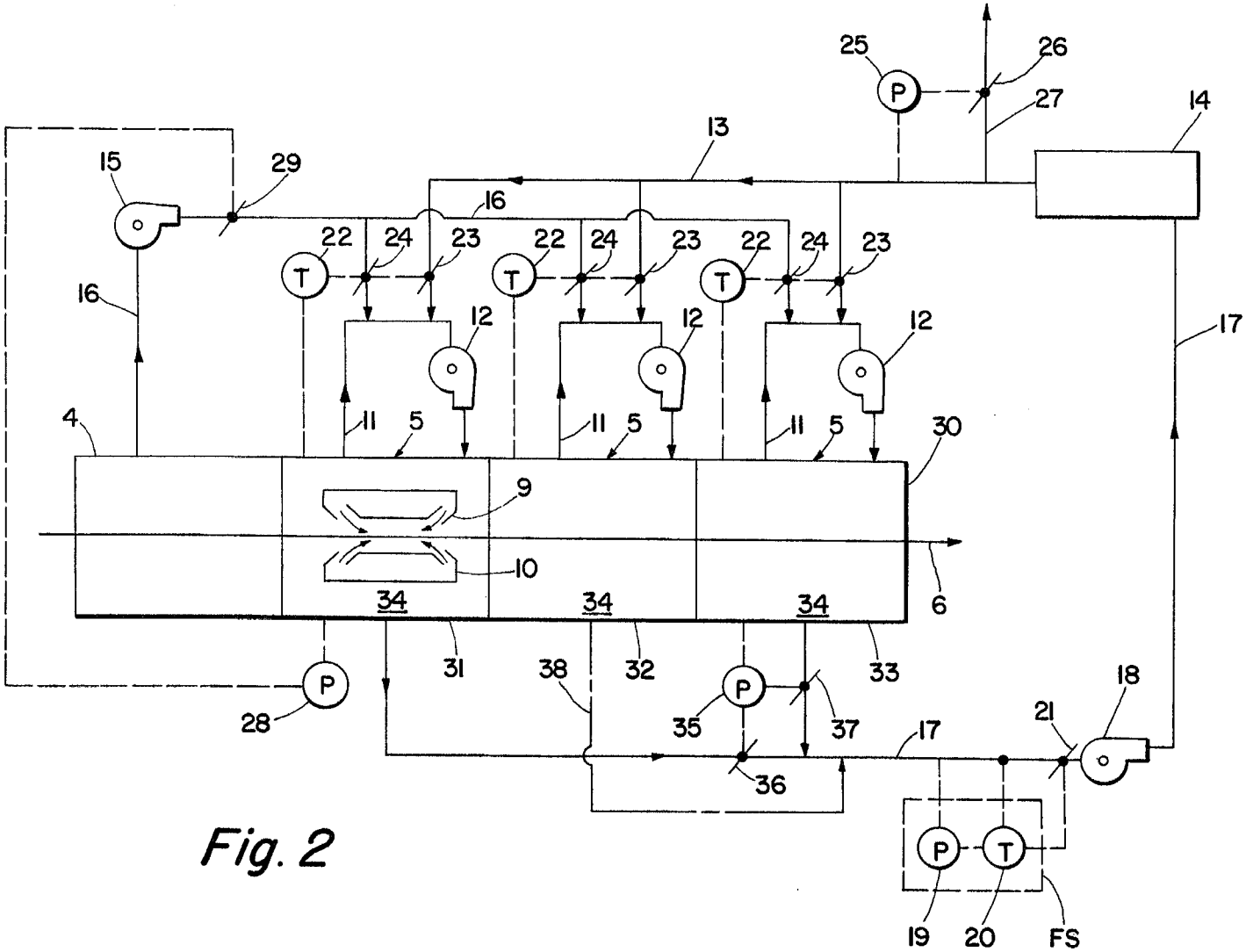
FIG. 2 is a schematic of another embodiment of the invention which employs a plurality of heat treatment zones.
Figure 2A:
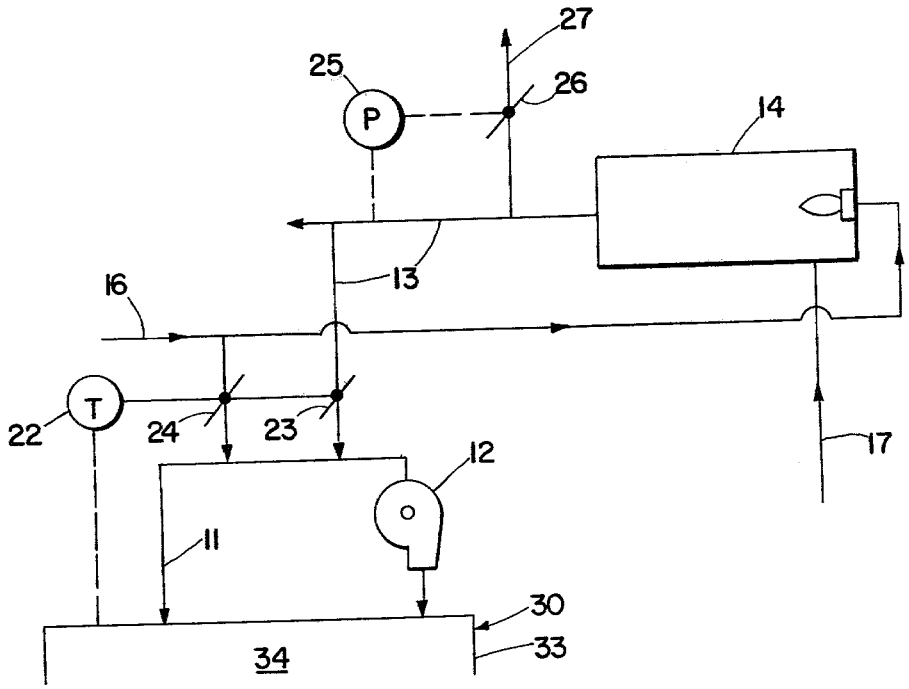
FIGS. 2*a*–2*d* are schematics of various improvements which can be adapted to the oven of FIG. 2.
Figure 2B:
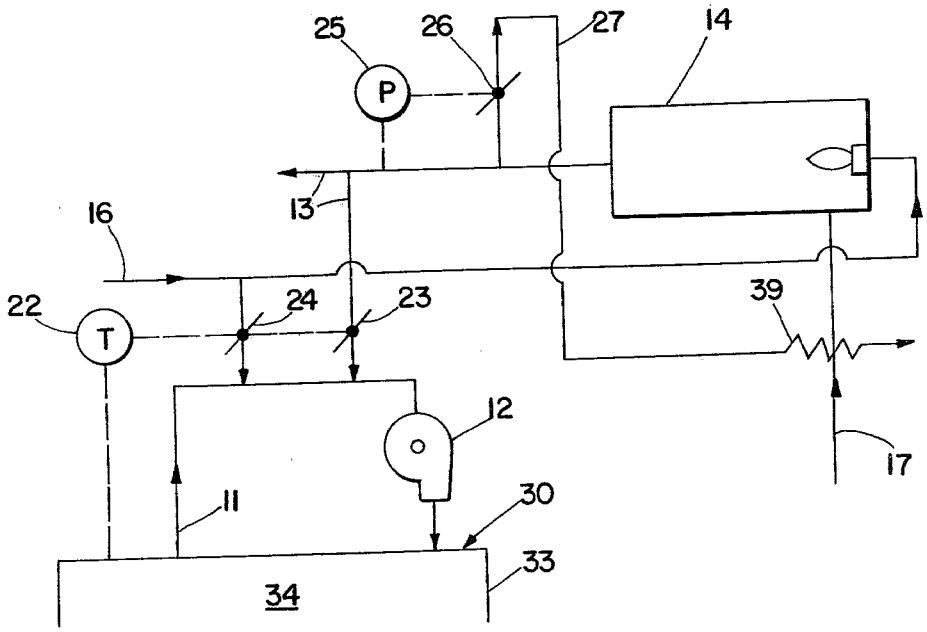
Figure 2C:
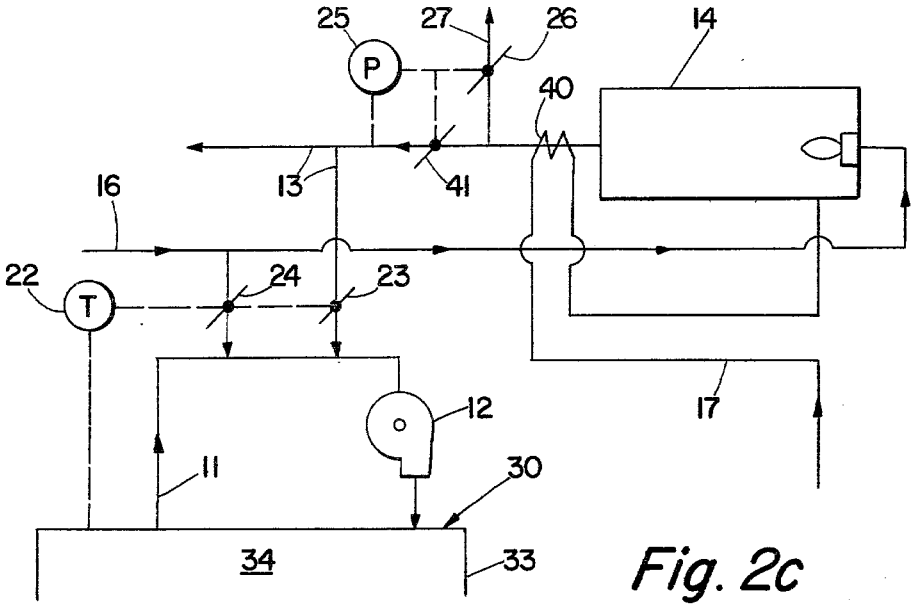
Figure 2D:
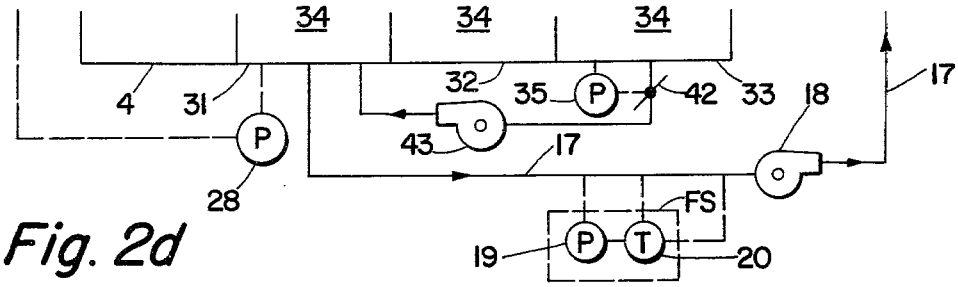

With particular reference to FIG. 2, there is shown a composite HV oven 30 which is essentially comprised of three of the basic HV ovens of FIG. 1. In this case, the composite HV oven 30 has three heat treatment zones 31–33 through which the continuous element 6 passes after it leaves the coater 4. In some cases, it may be desireable to provide a PH oven, as described in my copending application for preheating the continuous element 6, prior to passage into the composite HV oven 30. The heat treatment zones 31–33 are comprised of similar heat treatment chambers 34, each of which has two confronting rows of floatation-type nozzles 9,10 as previously described. The treatment chambers 34 are not completely sealed from each other, so that the gaseous atmosphere, for example, in the center chamber is free to circulate to the adjacent outer chambers and vice versa. It can be appreciated from a comparison of FIGS. 1 and 2 that the gas lines and temperature sensing devices used in conjunction with each zone of the composite HV oven 30, are essentially the same as those used in the basic HV oven 5 with slight modifications for exhausting gas and regulating the flow of cool gas to the composite HV oven. For example, gas is preferably exhausted only from the first and last zones 31,33 to be encountered by the continuous element 6 as it travels through the composite HV oven 30. A pressure sensing mechanism 35, provided to monitor the gas pressure within the last zone 33, controls the operation of a pair of dampers 36,37 which regulate the flow of exhaust gas from the first and last zones 31,33, to the fume incinerator 14 for heating and cascading back to the chambers 34 of the zones 31–33. In some cases, especially where a large number of heat treatment zones are being used, it may be desireable to exhaust gas from a zone intermediate the first and last zones. In such cases, there is provided in the most centrally disposed heat treatment zone, an exhaust conduit 38, which is connected to the main exhaust line 17 at a point which is upstream of the gas flow sensor FS and downstream of the point at which the exhaust gas from the first and last zones 31,33 flows into the exhaust line 17. Again, once the composite HV oven 30 is in operation and, in balance, where there is a constant rate of flow of hot and cool gas to the chambers 34 of the various heat treatment zones 31–33 and a corresponding constant rate of flow of gas exhausted from the composite HV oven 30 to maintain the pressure of the gaseous atmosphere within the chambers 34 at a desired norm, then all that is required when the composite oven becomes unbalanced is to modulate the flow of cool gas to the different chambers, to initiate action to return the composite oven to a balanced condition. As seen in FIG. 2, the pressure sensing device 28 that is used to control operation of the damper 29 to regulate the flow of cool gas to the heat treatment chambers 34, is used to monitor the gas pressure within the heat treatment chamber of the first zone 31.

With reference to FIG. *2a*, there is shown an improvement or modification of the composite HV oven 30, wherein a portion of the cool gas from the coater 4 is directed through the piping 16 to the fume incinerator 14 for admixture with, for example, natural gas that is used as a fuel in the operation of the burner within the fume incinerator 14.

With reference to FIG. *2b*, there is shown an additional improvement to that shown in previous FIG. *2a*. In this case, the hot gas from the fume incinerator 14 normally discharged to the ambient atmosphere via the discharge line 27 to maintain the pressure of hot gas in the inlet conduit 13 constant, is passed through a heat exchanger 39 that is used to preheat the exhaust gas being circulated to the fume incinerator 14 through the exhaust line 17, prior to exhaustion into the ambient atmosphere.

With reference to FIG. *2c*, there is shown a device which is designed to be used in conjunction with the improvement of FIGS. *2a* as an alternate device for preheating exhaust gas from the composite HV oven 30. In this case, the exhaust gas, prior to passage into the fume incinerator 14, is circulated through a heat exchanger 40 through which hot gas in the inlet conduit 13 is circulated. The pressure sensing device 25, used to control the damper 26 for exhausting hot gas into the ambient atmosphere, is used to control a damper 41 in the inlet conduit 13 to maintain the proper pressure of the hot gas being circulated to the various heat treatment chambers.

With reference to FIG. *2d*, there is shown an alternate embodiment for exhausting gas from the composite HV oven 30. The pressure sensing mechanism 35, provided to monitor the gas pressure in the last zone 33, controls operation of a damper 42 that is used to regulate the exhaustion of gaseous atmosphere from the last zone 33 to the first zone 31 from which exhaust gas is discharged through the exhaust line 17 to the fume incinerator 14. A conventional blower or fan 43 is used to circulate gaseous atmosphere from the last zone 33 to the first zone 31, so that, in effect, a controlled amount of highly diluted solvent vapor is removed from the third or last zone 33 for circulation directly to the first zone 31 to dilute the more highly concentrated solvent vapor in the first zone 31.

Figure 3:
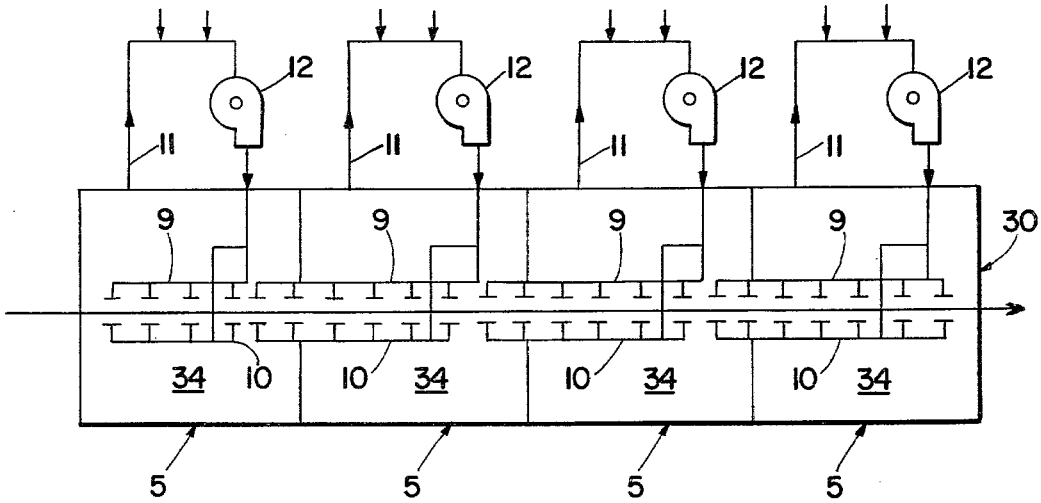
FIG. 3 is a schematic of an oven of the invention and is designed to show how heated gas can be cascaded through the various zones by the use of nozzles which extend into an adjacent upstream zone, relative to the movement of the element through the oven.

With reference to FIG. 3, there is shown a system by which treatment gas, circulated to a particular zone, is cascaded to the next adjacent upstream zone. This is accomplished by extending the floatation nozzle of a particular zone into the next adjacent upstream zone, relative to the direction in which the element travels through the oven.

Thus, there has been described a highly simplified system for controlling the balance of an oven by simply modulating the flow of cool gas to the oven. Moreover, the basic oven is economically designed to eliminate the need of costly heat exchangers used in the heating of the gas circulated to the various chambers of the oven, as hot gas from a fume incinerator is circulated directly to the oven.

What is claimed is:

1. An oven, comprising:

(a) at least one chamber which is substantially sealed from the ambient atmosphere;

(b) means for guiding an element, to be heated, through the chamber in a substantially horizontal pathway;

(c) means for circulating gas, heated to a certain desired temperature, to the chamber at a predetermined desired pressure;

(d) means for circulating gas, which is cool compared to the heated gas, to the chamber for mixture with the heated gas, prior to circulation of the mixture to the chamber for impingement against the element as it travels through the chamber, to produce in the chamber a gaseous atmosphere having a predetermined desired temperature and pressure;

(e) means for exhausting gas from the chamber at a predetermined constant flow rate;

(f) means for monitoring the gas pressure within the chamber; and (g) means for first modulating the flow of cool gas to the chamber when the gas pressure within the chamber varies from a desired norm.

2. The oven of claim 1, wherein the means (c) for circulating heated gas to the chamber includes:

(I) an incinerator for heating gas circulated thereto;

(II) means for circulating gas, exhausted from the chamber, to the incinerator for heating to a desired temperature and subsequent circulation to the chamber;

(III) means for monitoring the pressure of heated gas circulated to the chamber from the incinerator; and (IV) means for exhausting a portion of the heated gas from the incinerator to the ambient atmosphere in response to a change in the pressure of heated gas circulated to the chamber to maintain the desired pressure of heated gas circulated to the chamber.

3. The oven of claim 2, wherein the means (e) for exhausting gas from the chamber includes:

(I) means for monitoring the flow rate of gas exhausted from the chamber; and (II) means responsive to a change in the flow rate of gas exhausted from the chamber from a desired norm, for correspondingly varying the rate of flow of gas exhausted from the chamber to return the flow rate to the desired norm.

4. An oven, comprising:

(a) a plurality of adjacent disposed, aligned chambers which are substantially sealed from the ambient atmosphere and through which an element to be heated, travels in a substantially horizonal pathway;

(b) means for circulating gas, heated to a desired temperature, to each of the plurality of chambers at a predetermined pressure;

(c) means for circulating gas, cool compared to the heated gas, to each of the plurality of chambers at a predetermined rate of flow for admixture with heated gas being circulated thereto, prior to circulation of the mixture to the chambers for impingement against the element as it travels in the horizontal pathway, to produce in each chamber a gaseous atmosphere having a predetermined desired temperature;

(d) means for exhausting gas from the oven at a predetermined desired rate of flow, including means for monitoring the gas pressure in the last of the plurality of chambers to be encountered by the traveling element and for adjusting the exhaustion of gas from chambers of the oven when the gas pressure varies from a desired norm;

(e) means for monitoring the rate of flow of exhaust gas from the oven;

(f) means for adjusting the rate of flow of exhaust gas from the oven, when the flow rate varies from a desired norm;

(g) means for monitoring the gas pressure within the first of the plurality of chambers to be encountered by the traveling element; and (h) means for modulating the flow of cool gas to the chambers, when the gas pressure in the first chamber varies from the desired norm.

5. The oven of claims 1 or 4, which includes means for varying the mixture of heated and cool gas in response to modulation of the cool gas, when the temperature of the gaseous atmosphere varies from the desired temperature.

6. The oven of claim 4, which includes, separate means associated with each of the chambers for monitoring the temperature of gas therein, including means for varying the mixture of cool and hot gas circulated to a particular chamber when the temperature therein varies from a desired norm.

7. The oven of claim 6, which includes:

(i) means associated with each of the plurality of chambers for removing a portion of the gaseous atmosphere from a particular chamber and combining it with the mixture of hot and cool gas circulated to that particular chamber.

8. The oven of claim 6, wherein the means (b) for circulating heated gas to the chambers includes:

(j) means for heating gas circulated to each of the plurality of chambers;

(k) means for exhausting, to the ambient atmosphere, heated gas to maintain a desired pressure of heated gas circulated to each of the plurality of chambers; and (l) means for circulating gas, exhausted from the plurality of chambers, to the gas heating means for reheating and circulation to the chambers.

9. The oven of claim 6, wherein the means (d) for exhausting gas from the oven includes means for exhausting gas from the last to the first chamber to be encountered by the traveling element, and the means for monitoring the gas pressure in the last chamber is used to control the flow of exhaust gas from the last to the first chamber when the pressure being monitored varies from a desired norm.

10. The oven of claim 6, which includes at least two confronting rows of transversely oriented, spaced floatation-type nozzles for directing streams of high velocity gas against opposing sides of the element as it travels through the plurality of chambers.

11. The oven of claim 8, wherein the gas heating means includes a fume incinerator.

12. The oven of claim 8, which includes:

(m) means for circulating a portion of the cool gas to the gas heating means.

13. The oven of claim 8, which includes:

(n) a heat exchanger through which exhaust gas from the chambers is circulated prior to circulation to the gas heating means; and (o) means for circulating at least a portion of the heated gas from the gas heating means through the heat exchanger for preheating the exhaust gas circulating therethrough.

14. An oven comprising:

(a) a plurality of adjacently disposed aligned chambers which are sealed from the ambient atmosphere;

(b) means for guiding an element substantially horizontally through the plurality of chambers, including at least two confronting rows of transversely oriented, spaced floatation-type nozzles in each of the plurality of chambers for directing high velocity streams of gas against opposing sides of the element as it travels through the chambers;

(c) a fume incinerator, separate from the oven, for heating gas to a high temperature for circulation to each of the plurality of chambers;

(d) means for circulating the high temperature gas from the incinerator to each of the plurality of chambers at a certain desired pressure;

(e) means for monitoring the pressure of the high temperature gas circulated from the fume incinerator and adjusting the flow of the high temperature gas to the chambers to maintain the desired pressure, should the pressure vary from the desired pressure;

(f) means for circulating cool gas, compared to the high temperature heated gas, from a source to each of the plurality of chambers at a desired flow rate for mixture with the high temperature gas, prior to circulation of the mixture to the nozzles in each of the plurality of chambers;

(g) means associated with each of the plurality of chambers for recirculating gas, removed from a chamber, back to the chamber after the removed gas is mixed with the cool and high temperature gas from the source and fume incinerator to produce in each chamber a gaseous atmosphere at a desired temperature;

(h) means for monitoring the gas pressure within the chamber first to be encountered by the element as it travels through the oven, and adjusting the flow of cool gas to each of the plurality of chambers should the gas pressure within the first chamber vary from the desired gas pressure norm;

(i) separate means associated with each of the plurality of chambers for monitoring the temperature of the gaseous atmosphere within a chamber and controlling the amount of hot and cool gas in the mixture circulated to that chamber;

(j) means for exhausting gas at a certain desired flow rate from at least the first and last chambers to be encountered by the element as it travels through the oven, and circulating said gas to the fume incinerator;

(k) means for monitoring the flow rate of exhaust gas and adjusting the flow of exhaust gas when the flow rate varies from a certain desired flow rate;

(l) means for monitoring the gas pressure in the last chamber to be encountered by the element and adjusting the exhaustion of gas from the first and last chambers when the pressure in the last chamber varies from a certain desired pressure.

15. The oven of claim 14, which includes means for circulating gas, exhausted from the last chamber, to the first chamber.

16. The oven of claim 14, which includes means for circulating at least a portion of cool gas from the source to the fume incinerator for mixture with fuel of the burner.

17. The oven of claim 16, which includes a heat exchanger, and means for circulating exhaust gas from the chambers and hot gas from the fume incinerator through the heat exchanger in heat exchanging relation, prior to circulation of the exhaust gas to the fume incinerator.

* * * * *